US010974400B2

(12) United States Patent
Good et al.

(10) Patent No.: US 10,974,400 B2
(45) Date of Patent: Apr. 13, 2021

(54) GROOMING DEVICE

(71) Applicant: The Gillette Company LLC, Boston, MA (US)

(72) Inventors: Ian Anthony Good, Reading (GB); Werner Friedrich Johann Bonifer, Eschborn (DE); Faiz Feisal Sherman, Cincinnati, OH (US)

(73) Assignee: The Gillette Company LLC, Boston, MA (US)

( * ) Notice: Subject to any disclaimer, the term of this patent is extended or adjusted under 35 U.S.C. 154(b) by 0 days.

(21) Appl. No.: 16/658,703

(22) Filed: Oct. 21, 2019

(65) Prior Publication Data

US 2020/0122348 A1 Apr. 23, 2020

Related U.S. Application Data

(60) Provisional application No. 62/747,717, filed on Oct. 19, 2018.

(51) Int. Cl.

| | |
|---|---|
| ***B26B 19/38*** | (2006.01) |
| ***B26B 21/40*** | (2006.01) |
| ***B26B 21/52*** | (2006.01) |
| *F21Y 115/10* | (2016.01) |

(52) U.S. Cl.

CPC ..... *B26B 19/388* (2013.01); *B26B 19/382* (2013.01); *B26B 21/4056* (2013.01); *B26B 21/526* (2013.01); *F21Y 2115/10* (2016.08)

(58) Field of Classification Search

CPC . B26B 21/4056; B26B 21/526; B26B 19/388; B26B 19/382; F21Y 2115/10

See application file for complete search history.

(56) References Cited

U.S. PATENT DOCUMENTS

| | | | | |
|---|---|---|---|---|
| 5,983,502 | A * | 11/1999 | Geertsma | B26B 19/14 30/43 |
| 6,189,215 | B1 | 2/2001 | Beerwerth et al. | |
| 8,615,886 | B1 | 12/2013 | Childers | |
| 9,126,346 | B2 | 9/2015 | Meier et al. | |
| 9,174,351 | B2 | 11/2015 | Binder | |
| 2008/0168657 | A1 | 7/2008 | Cloke | |
| 2009/0000126 | A1* | 1/2009 | Kraus | B26B 19/046 30/34.1 |
| 2012/0167392 | A1 | 7/2012 | Cherian et al. | |
| 2014/0137883 | A1 | 5/2014 | Rothschild | |
| 2015/0183118 | A1 | 7/2015 | Roth | |
| 2015/0205279 | A1 | 7/2015 | Simeth | |
| 2019/0306259 | A1* | 10/2019 | Burghardt | B26B 19/048 |

* cited by examiner

*Primary Examiner* — Omar Flores Sanchez

(74) *Attorney, Agent, or Firm* — Kevin C. Johnson

(57) ABSTRACT

A grooming device including a handle and a grooming implement connected to the handle. The handle includes a first portion having a housing, a proximal end and a distal end. A displacement sensor is positioned within the housing. A power source is positioned within the housing with the power source providing power to the displacement sensor. A neck portion is pivotably connected to the proximal end of the first portion about a handle pivot axis. The neck portion includes a proximal end, a distal end and a location element. As the neck portion pivots about the handle pivot axis relative to the first portion the displacement sensor detects displacement of the location element.

15 Claims, 7 Drawing Sheets

GROOMING DEVICE

FIELD OF THE INVENTION

The present invention relates to a grooming device and more particularly to a grooming device having the ability to improve the usage experience of the grooming device by providing information about the usage experience to the user related to the grooming device.

BACKGROUND OF THE INVENTION

There are numerous grooming devices used by consumers every day. Proper usage techniques of such grooming devices facilitate the overall efficacy of the product providing the user with a more positive experience than he or she would have otherwise experienced. Such positive usage experiences will likely lead to continued product usage. Providing the user with information about proper usage techniques for using grooming devices appliance has been limited.

Razors with sensors have been used to provide information to the user. Razors with proximity sensors or cameras have been used to provide information on blade attrition. Razors with force sensors have been used to provide the user with information on the amount of force being applied to the skin. By tracking the force being applied during the shave provides a metric to gauge blade dulling and predict blade attrition. Razors having sensors to count shaving strokes have been used to again assist with blade attrition. Cameras have been used to provide users with boundary indicators such as distinguishing between areas of long hair such as side burns adjacent to areas of shorter hair length.

To date the devices providing force and blade life tracking have been limited in their commercial viability given the complicated and expensive designs. There is a desire to provide a grooming device with force indication and blade life tracking in a simple and cost-effective design. Such a design has yet to be provided.

SUMMARY OF THE INVENTION

The present invention relates to a grooming device. The grooming device comprises a handle. The handle comprises a first portion comprising a housing, a proximal end and a distal end. A displacement sensor is positioned within the housing. A power source is positioned within the housing. The power source provides power to the displacement sensor. The handle comprises a neck portion comprising a proximal end, a distal end and a location element. The proximal end of the neck portion comprises an implement connecting structure. The distal end of the neck portion is pivotably connected to the proximal end of the first portion about a handle pivot axis. As the neck portion pivots about the handle pivot axis relative to the first portion the displacement sensor detects displacement of the location element. A grooming implement is connected to the implement connecting structure.

The location element is positioned adjacent the distal end of the neck portion.

The displacement sensor is positioned adjacent the proximal end of the first portion.

A spring may be positioned between the distal end of the neck portion and the proximal end of the first portion.

The grooming device may comprise an electric shaver, a shaving razor and/or an epilator.

An algorithm is used to calculate a load being placed on the grooming implement based on displacement of the location element.

The grooming device may comprise a feedback mechanism positioned in the first portion. The feedback mechanism may comprise a visual indicator, an LED, a vibration mechanism, and/or an audio mechanism. The feedback mechanism may indicate a pressure, or a load state being placed on the handle.

The grooming device may comprise an eject button to eject the grooming implement from the handle, the location element being negatively displaced upon depression of the eject button The displacement sensor may comprise a magnetometer, an electric field sensor or a light sensor. The magnetometer may comprise a Hall Effect sensor.

The location element may comprise a magnet, a visual marker or an electrically conductive material.

The grooming device may comprise a second magnetometer positioned within the housing.

The distal end of the neck portion is pivotably connected to the proximal end of the first portion by a hinge. The hinge may comprise an elastomer, a plastic material, a pin or a metal.

The grooming device may comprise a memory storage device positioned within the housing. The grooming device may comprise a communication device positioned within the housing. The communication device may communicate with a second device.

The housing may be watertight to protect the sensors, devices and power source positioned with the housing.

BRIEF DESCRIPTION OF THE DRAWINGS

While the specification concludes with claims particularly pointing out and distinctly claiming the subject matter which is regarded as forming the present invention, it is believed that the invention will be better understood from the following description which is taken in conjunction with the accompanying drawings in which like designations are used to designate substantially identical elements, and in which:

DETAILED DESCRIPTION OF THE INVENTION

Figure 1:
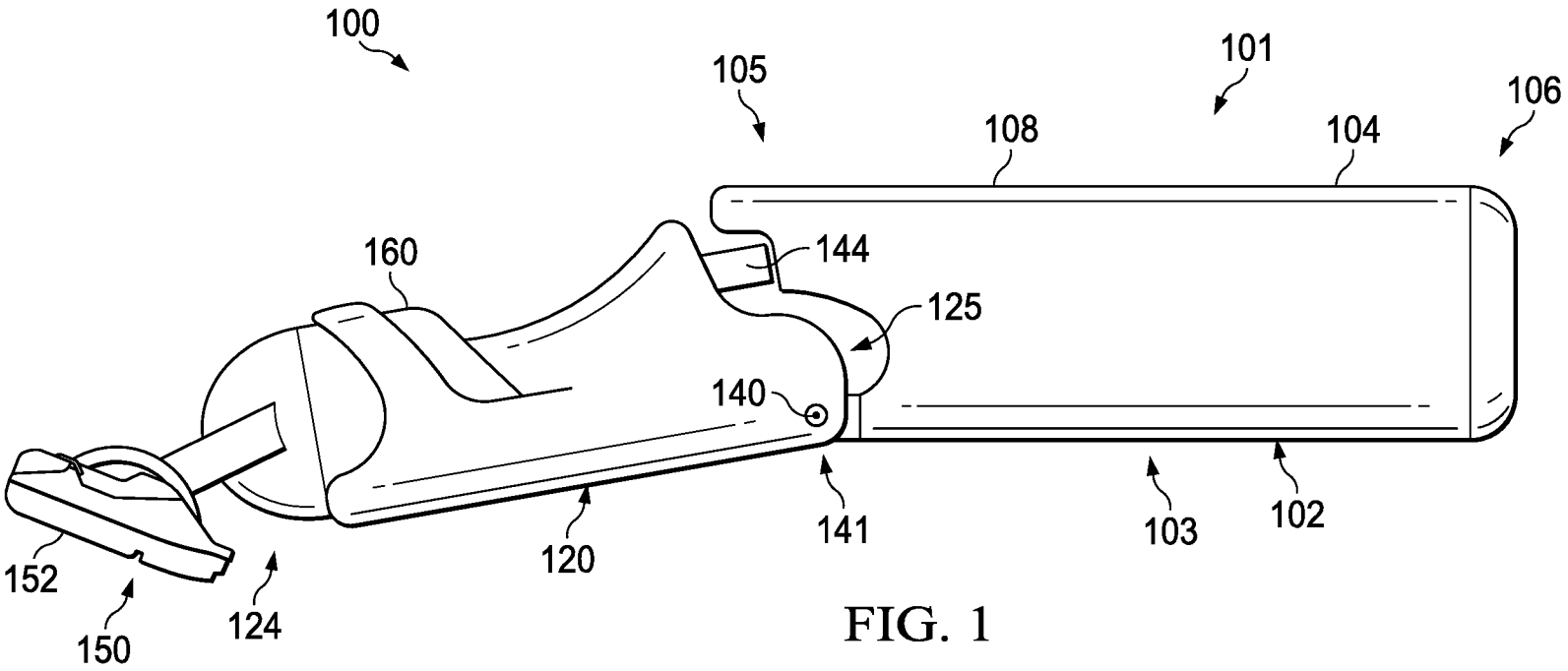
FIG. 1 is a view of a grooming device of the present invention.
Figure 2:
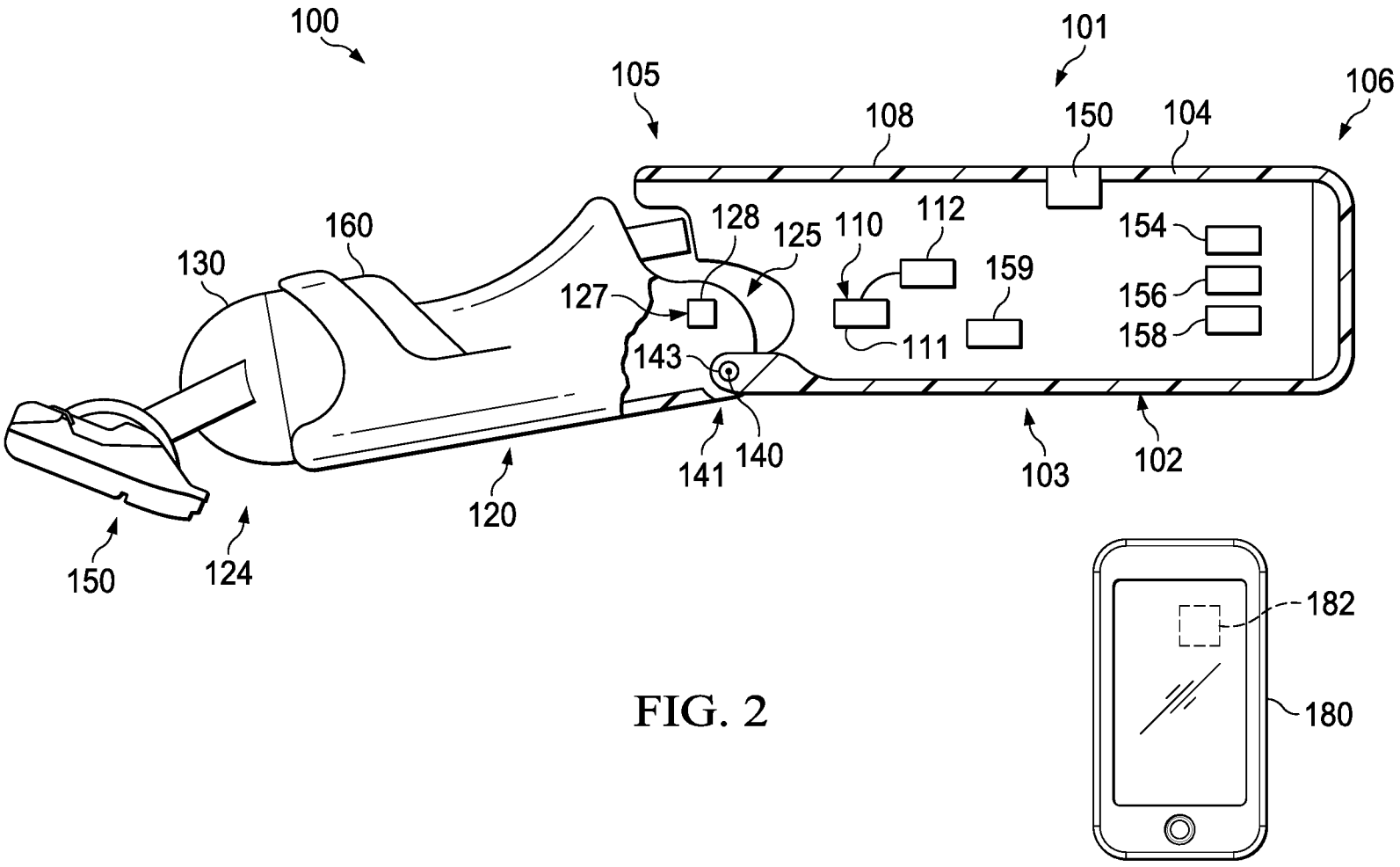
FIG. 2 is a cut away view of the grooming device of FIG. 1 and a second device of the present invention.

Referring now to FIGS. 1-2 there is shown a grooming device 100. The grooming device 100 shown is a shaving razor 101. The shaving razor 101 is just one example of a grooming device of the present invention. Examples of other grooming devices of the present invention include an electric shaver, and an epilator.

The grooming device 100 comprises a handle 102. The handle 102 comprises a first portion 103 comprising a housing 104, a proximal end 105 and a distal end 106. A displacement sensor 110 is positioned within the housing 104. A power source 112 is positioned within the housing 104. The power source 112 provides power to the displacement sensor 110. The power source also provides power to other sensors and devices needing power. The power source 112 may comprise a rechargeable battery, a disposable battery or a corded electrical connection. The first portion 103 forms the grip portion 108 for the handle 102 where the user will grasp the handle 102 during use.

The handle 102 comprises a neck portion 120 comprising a proximal end 124, a distal end 125 and a location element 127. The proximal end 124 of the neck portion 120 comprising an implement connecting structure 130. The distal end 125 of the neck portion 120 is pivotably connected to the proximal end 105 of the first portion 103 about a handle pivot axis 140. As the neck portion 120 pivots about the handle pivot axis 140 relative to the first portion 103 the displacement sensor 110 detects displacement of the location element 127.

Figure 3:
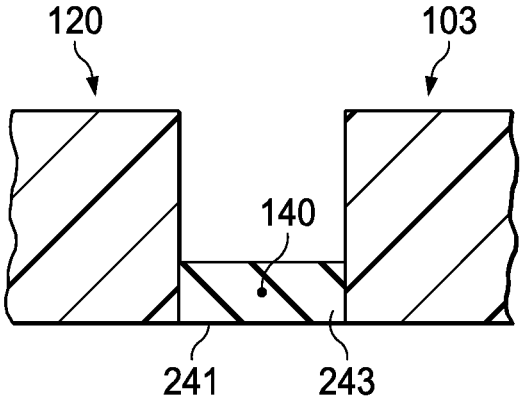
FIG. 3 is a side view showing a hinge.
Figure 4:
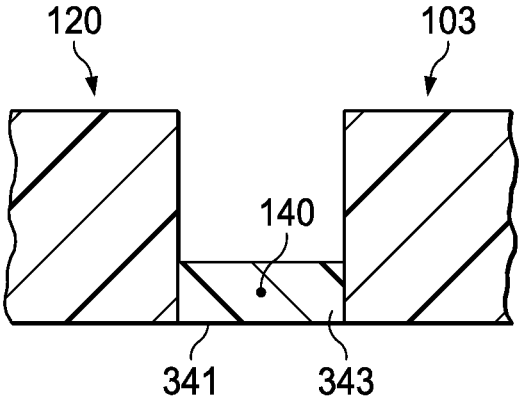
FIG. 4 is a side view showing another hinge.

The distal end 125 of the neck portion 120 is pivotably connected to the proximal end 105 of the first portion 103 by a hinge 141. Hinge 141 allows the neck portion 120 to pivot about handle pivot axis 140 relative to the first portion 103. In FIG. 2, the hinge shown is a pin 143. The pin 143 may be constructed of numerous materials having the requisite strength properties with metal being the preferred material. Referring now to FIG. 3, another type of a hinge 241 is shown. Hinge 241 may be an elastomer 243 that allows the neck portion 120 to pivot about handle pivot axis 140 relative to the first portion 103. Referring now to FIG. 4, another type of a hinge 341 is shown. Hinge 341 may be a plastic material 343 that allows the neck portion 120 to pivot about handle pivot axis 140 relative to the first portion 103.

Referring again to FIGS. 1-2, a grooming implement 150 is connected to the implement connecting structure 130. The grooming implement 150 shown is a razor cartridge 152. The razor cartridge 152 includes at least one blade for cutting hair. The razor cartridge 152 may include any number of blades for cutting hair.

The location element 127 is positioned adjacent the distal end 125 of the neck portion 120. Other locations within the neck portion may be selected with adjacent the distal end being the preferred location for the location element 127. The displacement sensor 110 is positioned within the first portion 103 adjacent the proximal end 105 of the first portion 103. Other locations within the first portion may be selected with adjacent the proximal end being the preferred location for the displacement sensor 110. The location element 127 may comprise a magnet 128. The location element 127 may also comprise a visual marker or an electrically conductive material.

The displacement sensor 110 may comprise a magnetometer, an electric field sensor or a light sensor. The magnetometer may comprise a Hall Effect sensor. The location element may comprise a magnet, a visual marker or an electrically conductive material. As the neck portion 120 pivots about handle pivot axis 140 location element 127 moves relative to displacement sensor 110. In the case of a magnet and a hall effect sensor, as neck portion 120 pivots magnet 128 moves. The Hall Effect sensor 111 detects the change in magnetic field due to the movement of magnet 128.

The grooming device 100 may comprise a second displacement sensor such as a magnetometer 158 positioned within the housing 104. The second magnetometer 158 can be used to cancel out any movements detected by the first displacement sensor or magnetometer not directly associated with the magnet 128.

Figure 5:
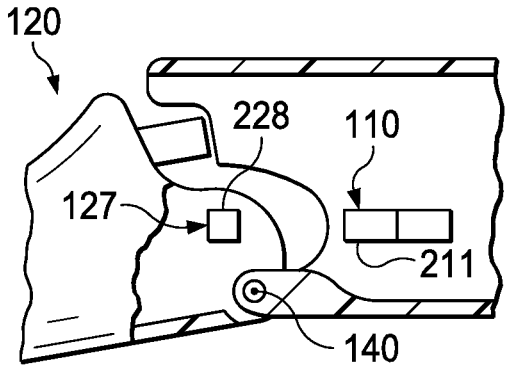
FIG. 5 is a side view showing another displacement sensor and location element.

Referring now to FIG. 5, the displacement sensor 110 may comprise a light sensor 211. The location element 127 may comprise a light source or visual marker 228. As the neck portion 120 pivots about handle pivot axis 140, light source or visual marker 228 moves and the movement of light source or visual marker 228 is detected by the light sensor 211.

Figure 6:
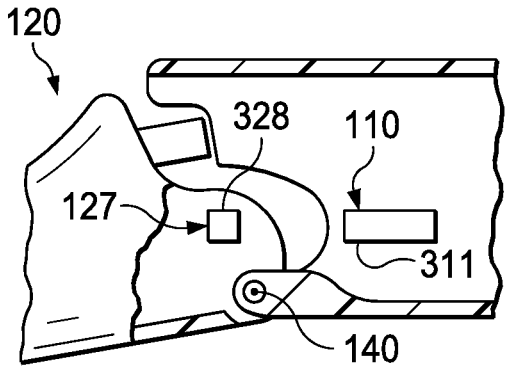
FIG. 6 is a side view showing another displacement sensor and location element.

Referring now to FIG. 6, the displacement sensor 110 may comprise an electric field sensor 311. The location element 127 may comprise an electrically conductive material 328. As the neck portion 120 pivots about handle pivot axis 140, electrically conductive material 328 moves and disturbs the electric field generated by electric field sensor 311 and is detected by the electric field sensor 311.

Referring again to FIGS. 1-2, the grooming device 100 may comprise a spring 144 positioned between the distal end 125 of the neck portion 120 and the proximal end 105 of the first portion 103. The spring 144 may be a compression spring, a coil spring, a constant rate spring or a variable rate spring.

The grooming device 100 may comprise a feedback mechanism 150. Preferably the feedback mechanism is positioned in the first portion 103. The feedback mechanism 150 provides the user with information about the grooming experience. The feedback mechanism 150 may be a visual indicator such as an LED or LCD display. The feedback mechanism 150 may be a vibration mechanism and/or an audio mechanism.

A single or multiple feedback mechanisms 150 may be used depending on the desired communication with the user. The feedback mechanism may indicate a pressure or a load state. For example, the feedback mechanism may be an LED which shows a green color for grooming within a proper pressure or load and a red color for grooming above a proper pressure or load state.

Preferably the housing 104 is watertight thus allowing the device to be used in wet conditions while maintaining the functioning of the displacement sensor 110 and power source 112 within the housing. The neck portion 120 does not need be watertight as it does not house any devices or elements that would impact their functioning if exposed to water.

The grooming device 100 may comprise a memory storage device 154 positioned within the housing 104. The memory storage device 154 may comprise a non-volatile flash memory, a non-volatile flash memory card, a hard disk and/or a volatile DRAM.

The grooming device 100 may comprise a communication device 156 positioned within the housing. The communication device 156 may comprise a wireless connection, a wired connection, a removable memory card, a vibration device, microphone, an audio device and/or a visual indicator such as an LED or LCD display. The communication device 156 allows the grooming device 100 to communicate with a user and/or a second device 180. The second device 180 comprises a second communication device 182 that can communicate with communication device 156. The communication with a second device 180 may be wirelessly through a cloud architecture and wirelessly to the second device. The wireless communication may be made via a Wi-Fi connection, a SIM card with GSM connection, a Bluetooth transmitter, a Li-Fi connection, and an infra-red transmitter. The communication may be directly to the second device. The second device 180 may be a mobile phone, a computer application, a computer, an electronic device or a base for holding the razor.

In use, the user will grasp the grip portion 108 of handle 102. The power source 112 will power up and power the sensors needing power. The power source 112 may power up automatically upon contact with or movement by the user. Alternatively, the power source 112 may power up via an on/off switch. Alternatively, the power source 112 may be constantly on and preferably in a power save mode while not in use and then in full power mode when in use. The user will then groom.

As the user grooms, data is collected from the displacement sensor 110. The data collected can be used to calculate the pressure and or load on the handle 102 as well as contact data. The data collected may also be used to calculate the number and length of each grooming stroke experienced and the total distance or mileage the grooming implement has experienced at any given point in time. When the user is finished grooming, the grooming device 100 is put down and data collection stops. The collected data may be transmitted instantaneously as the data is collected via the communication device 156. Alternatively, the collected data is transmitted after the data from a single grooming event or multiple grooming events has been collected via the communication device 156. The data whether transmitted instantaneously or after a period of time can be transmitted through the feedback mechanism 150. The feedback mechanism 150 may be in the form of a color coming from an LED, such as yellow indicating that the pressure being exerted on the grooming implement is getting near a maximum pressure that is to be exerted and red indicating that the pressure being exerted is exceeding the maximum pressure that is to be exerted on grooming implement.

The grooming device may comprise an eject button 160. As a user depresses eject button 160 the grooming implement is ejected from the handle.

Figure 7:
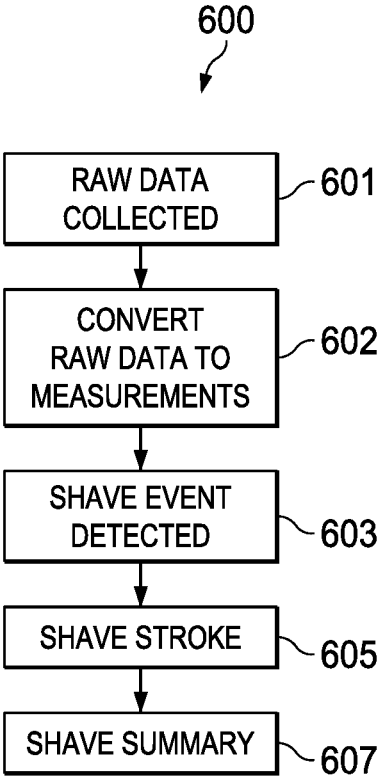
FIG. 7 is a plan diagram of the collected shave data and associated algorithms.

Referring now to FIG. 7 there is shown a plan diagram 600 of the collected data and algorithms used with grooming device 100. With the power source 112 on raw data is collected 601 during the grooming event from displacement sensor 110. The raw data is then converted into measurements at 602. The measurements may be made by a logic device such as microprocessor. The microprocessor 159 may be located within the housing 104 of handle 102 (shown in FIG. 2). Alternatively, the raw data can be sent from communication device 156 to an external second device 180 (shown in FIG. 2) such as a mobile phone, a computer application, a computer or electronic device where measurements may be made by a logistic device such as a microprocessor. At 603 the grooming event is detected from the raw data of the displacement sensor 110 using an algorithm. The algorithm may comprise of monitoring the displacement detected by displacement sensor 110 while the grooming device is in a static condition to detect the presence of grooming implement 150. The algorithm may comprise of monitoring the activity strength as recorded by displacement sensor 110. For example, if a user starts shaving there would be activation of the displacement sensor 110 when grooming implement 150 touches the skin on the user's face causing the neck portion to pivot. The same logic can be used to determine if razor cartridge 106 has been ejected by looking for a signal of negative displacement on displacement sensor 110. When eject button 160 is depressed the grooming implement in this embodiment razor cartridge 106 is ejected from the handle. As the user depresses eject button 160 the location element 127 is displaced in a negation direction away from the displacement sensor. The negative movement is an indication that the grooming implement has been ejected from the handle. Also, it can be understood that time between signals and events can be used to determine actions like re-application of shave cream.

At 605 a shave stroke can be detected from the raw data of the displacement sensor 110. An algorithm looking at activation of implement displacement sensor 110 can be used to indicate expected motion that represents a shave stroke.

At 607 a summary of the shave can be generated from a combination of 602, 603, and 605. 607 can also be fused with other information directly from the consumer to add an extra level of context such as the number of strokes that were made or the pressure of such strokes. The device may have additional motion sensors to detect additional device movements. Information from either 602, 603, or 605 and the user input providing information on what direction is their hair growing on a location of their face.

Figure 8:
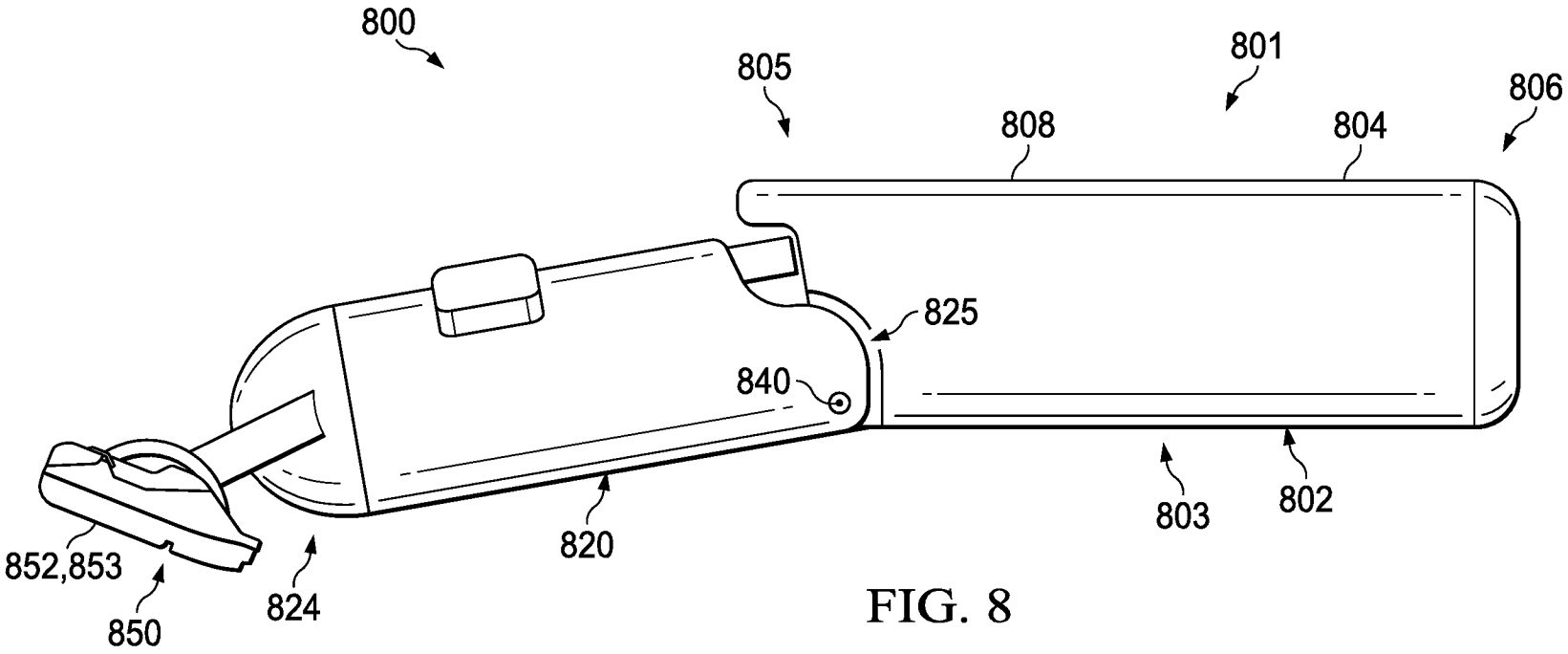
FIG. 8 is a side view of another grooming device of the present invention.
Figure 9:
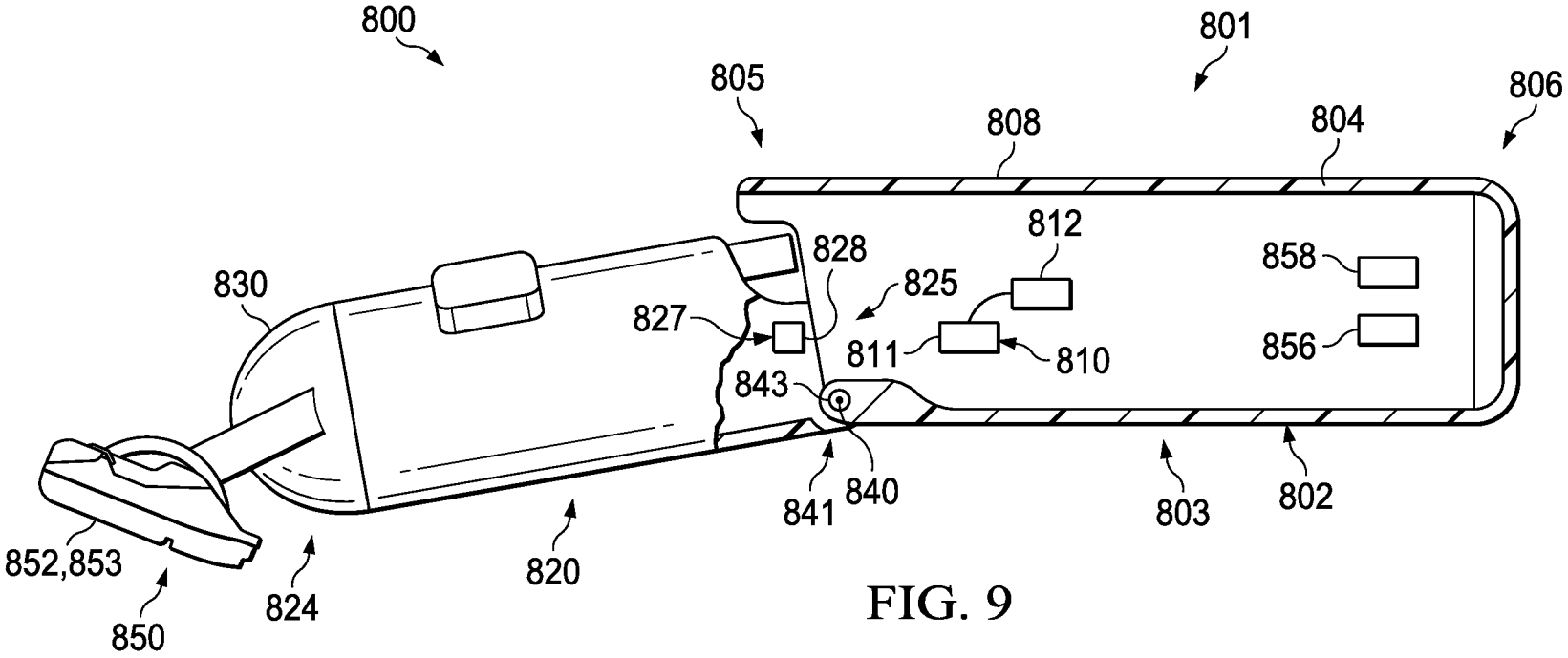
FIG. 9 is a cut away view of the grooming device of FIG. 8.

Referring now to FIGS. 8 and 9, there is shown another grooming device 800. The grooming device 800 shown is an electric shaver or an epilator 801. The electric shaver or epilator 801 comprises a handle 802. The handle 802 comprises a first portion 803 comprising a housing 804, a proximal end 805 and a distal end 806. A displacement sensor 810 is positioned within the housing 804. A power source 812 is positioned within the housing 804. The power source 812 provides power to the displacement sensor 810. The power source also provides power to other sensors and devices needing power. The power source 812 may comprise a rechargeable battery, a disposable battery or a corded electrical connection. The first portion 803 forms the grip portion 808 for the handle 802 where the user will grasp the handle 802 during use.

The handle 802 comprises a neck portion 820 comprising a proximal end 824, a distal end 825 and a location element 827. The proximal end 824 of the neck portion 820 comprising an implement connecting structure 830. The distal end 825 of the neck portion 820 is pivotably connected to the proximal end 805 of the first portion 803 about a handle pivot axis 840. As the neck portion 820 pivots about the handle pivot axis 840 relative to the first portion 803 the displacement sensor 810 detects displacement of the location element 827.

The distal end 825 of the neck portion 820 is pivotably connected to the proximal end 805 of the first portion 803 by a hinge 841. Hinge 841 allows the neck portion 820 to pivot about handle pivot axis 840 relative to the first portion 803. The hinge shown is a pin 843. The pin 843 may be constructed of numerous materials having the requisite strength properties with metal being the preferred material. Other types of hinges such as those shown in FIGS. 3 and 4 may be used.

A grooming implement 850 is connected to the implement connecting structure 830. The grooming implement 850 shown is an electric shaver head 852 or an epilator head 853. The electric shaver head 852 includes at least one moveable blade for cutting hair. The electric shaver head 852 may include any number of moveable blades for cutting hair. The epilator head 853 may include any number of grips for gripping and removing hair.

The location element 827 is positioned adjacent the distal end 825 of the neck portion 820. Other locations within the neck portion may be selected with adjacent the distal end being the preferred location for the location element 827. The displacement sensor 810 is positioned within the first portion 803 adjacent the proximal end 805 of the first portion 803. Other locations within the first portion may be selected with adjacent the proximal end being the preferred location for the displacement sensor 810. The location element 827 may comprise a magnet 828. The location element 827 may also comprise a visual marker or electrically conductive material.

The displacement sensor 810 may comprise a magnetometer, an electric field sensor or a light sensor. The magnetometer may comprise a Hall Effect sensor. The location element may comprise a magnet. As the neck portion 820 pivots about handle pivot axis 840 location element moves relative to displacement sensor 810. In the case of a magnet and a Hall Effect sensor, as neck portion 820 pivots magnet 828 moves. The Hall Effect sensor 811 detects the change in magnetic field due to the movement of magnet 828.

The electric shaver 801 may comprise a second magnetometer 858 positioned within the housing 804. The second magnetometer 858 can be used to cancel out any movements not directly associated with the magnet 828.

In use, the user will grasp grip portion 808 of handle 802. The power source 812 will power up and power the sensors needing power. The power source 812 may power up automatically upon contact with or movement by user. Alternatively, the power source 812 may power up via an on/off switch. Alternatively, the power source 812 may be constantly on and preferably in a power save mode while not in use and then in full power mode when in use. The user will then shave with electric shaver 801. As the user shaves, data is collected from the displacement sensor 810. When the user is finished shaving, the electric shaver 801 is put down and data collection stops. The collected data may be transmitted instantaneously as the data is collected via the communication device 856 positioned within housing 804. Alternatively, the collected data is transmitted after the data from a single shaving event or multiple shaving events has been collected via the communication device 856.

Figure 10:
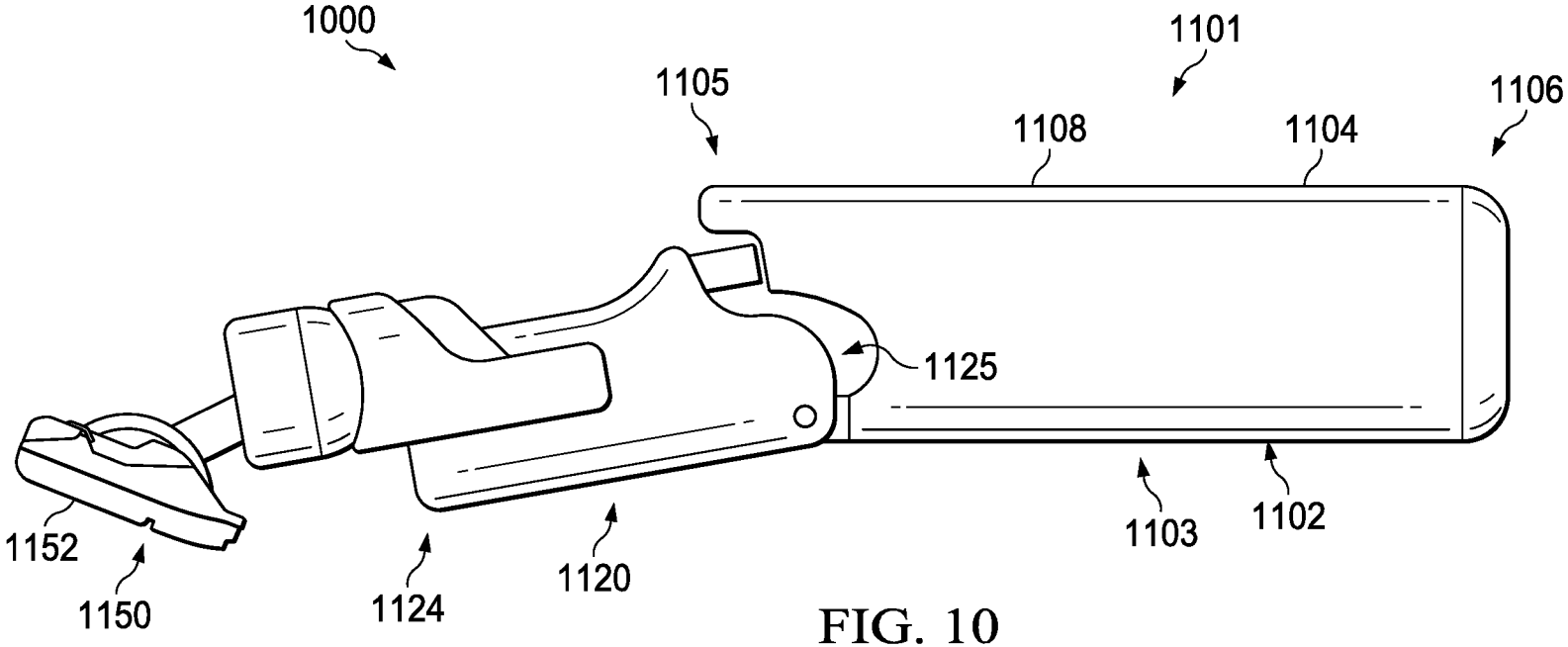
FIG. 10 is a side view of another grooming device of the present invention.
Figure 11:
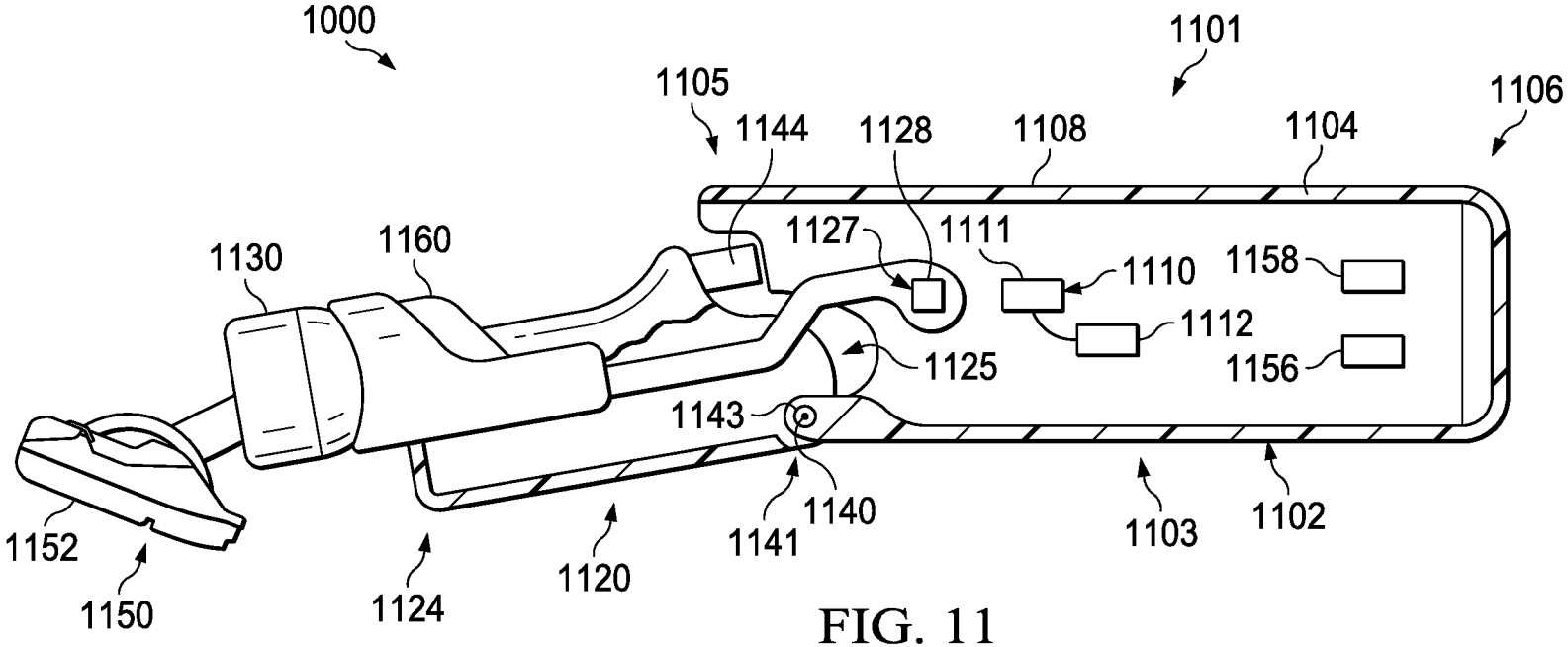
FIG. 11 is a cut away view of the grooming device of FIG. 10.

Referring now to FIGS. 10 and 11 there is shown a grooming device 1000. The grooming device 1000 shown is a shaving razor 1101. The shaving razor 1101 is just one example of a grooming device of the present invention. Examples of other grooming devices of the present invention include an electric shaver, and an epilator.

The grooming device 1000 comprises a handle 1102. The handle 1102 comprises a first portion 1103 comprising a housing 1104, a proximal end 1105 and a distal end 1106. A displacement sensor 1110 is positioned within the housing 1104. A power source 1112 is positioned within the housing 1104. The power source 1112 provides power to the displacement sensor 1110. The power source also provides power to other sensors and devices needing power. The power source 1112 may comprise a rechargeable battery, a disposable battery or a corded electrical connection. The first portion 1103 forms the grip portion 1108 for the handle 1102 where the user will grasp the handle 1102 during use.

The handle 1102 comprises a neck portion 1120 comprising a proximal end 1124, a distal end 1125 and a location element 1127. The proximal end 1124 of the neck portion 1120 comprising an implement connecting structure 1130. The distal end 1125 of the neck portion 1120 is pivotably connected to the proximal end 1105 of the first portion 1103 about a handle pivot axis 1140. As the neck portion 1120 pivots about the handle pivot axis 1140 relative to the first portion 1103 the displacement sensor 1110 detects displacement of the location element 1127.

The distal end 1125 of the neck portion 120 is pivotably connected to the proximal end 1105 of the first portion 1103 by a hinge 1141. Hinge 1141 allows the neck portion 1120 to pivot about handle pivot axis 1140 relative to the first portion 1103. The hinge shown is a pin 1143. The pin 1143 may be constructed of numerous materials having the requisite strength properties with metal being the preferred material. Other types of acceptable hinges are shown in FIGS. 3 and 4.

A grooming implement 1150 is connected to the implement connecting structure 1130. The grooming implement 1150 shown is a razor cartridge 1152. The razor cartridge 1152 includes at least one blade for cutting hair. The razor cartridge 1152 may include any number of blades for cutting hair. Other grooming implements such as a dry shaving head or an epilator head may be connected to the implement connecting structure.

The location element 1127 is positioned adjacent the distal end 1125 of the neck portion 1120. Other locations within the neck portion may be selected with adjacent the distal end being the preferred location for the location element 1127. The displacement sensor 1110 is positioned within the first portion 1103 adjacent the proximal end 1105 of the first portion 1103. Other locations within the first portion may be selected with adjacent the proximal end being the preferred location for the displacement sensor 1110. The location element 1127 may comprise a magnet 1128. The location element 1127 may also comprise a light source or an electric field source.

The displacement sensor 1110 may comprise a magnetometer, an electric field sensor or a light sensor. The magnetometer may comprise a Hall Effect sensor. The location element may comprise a magnet, a visual marker or an electrically conductive material. As the neck portion 1120 pivots about handle pivot axis 1140 location element 1127 moves relative to displacement sensor 1110. In the case of a magnet and a Hall Effect sensor, as neck portion 1120 pivots magnet 1128 moves. The Hall Effect sensor 1111 detects the change in magnetic field due to the movement of magnet 1128.

The grooming device 1000 may comprise a second displacement sensor such as a magnetometer as shown in FIGS. 1 and 2. The second displacement sensor may be used to cancel out movement detected by the first displacement sensor not associated with the location element.

The grooming device 1000 may comprise a spring 1144 positioned between the distal end 1125 of the neck portion 1120 and the proximal end 1105 of the first portion 1103. The spring 1144 may be a compression spring, a coil spring, a constant rate spring or a variable rate spring.

The grooming device 1000 may comprise a feedback mechanism as discussed earlier. Preferably the housing is watertight thus allowing the device to be used in wet conditions while maintaining the functioning of the displacement sensor and power source within the housing. The neck portion does not need be watertight as it does not house any devices or elements that would impact their functioning if exposed to water.

The grooming device 1000 may comprise a memory storage device as discussed earlier. The grooming device 1000 may comprise a communication device as discussed earlier.

In use, the user will grasp the grip portion 1108 of handle 1102. The power source 1112 will power up and power the sensors needing power. The power source 1112 may power up automatically upon contact with or movement by user. Alternatively, the power source 1112 may power up via an on/off switch. Alternatively, the power source 1112 may be constantly on and preferably in a power save mode while not in use and then in full power mode when in use. The user will then groom.

As the user grooms, data is collected from the displacement sensor 1110. The data collected can be used to calculate the pressure and or load on the handle 1102 as well as contact data. The data collected may also be used to calculate the number and length of each grooming stroke experienced and the total distance or mileage the grooming implement has experienced at any given point in time. When the user is finished grooming the grooming device 1000 is put down and data collection stops. The collected data may be transmitted instantaneously as the data is collected via a communication device. Alternatively, the collected data is transmitted after the data from a single grooming event or multiple grooming events has been collected via a communication device. The data whether transmitted instantaneously or after a period of time can be transmitted through the feedback mechanism.

Cartridge removal can also be detected. As the user depresses or pushes the eject button 1160 the grooming implement or cartridge 1152 is ejected from the handle. As the user depresses or pushes eject button 1160 the magnet 1128 travels in a negative direction away from displacement sensor 1127. The negative movement of magnet 1128 is an indication that the grooming implement or cartridge 1152 has been ejected from the handle.

An example is below:

A. grooming device comprising:
  a. a handle comprising;
    i. a first portion comprising a housing, a proximal end and a distal end;
    ii. a displacement sensor positioned within the housing;
    iii. a power source positioned within the housing, the power source providing power to the displacement sensor;
    iv. a neck portion comprising a proximal end, a distal end and a location element, the proximal end of the neck portion comprising an implement connecting structure, the distal end of the neck portion being pivotably connected to the proximal end of the first portion about a handle pivot axis, as the neck portion pivots about the handle pivot axis relative to the first portion the displacement sensor detects displacement of the location element; and
  b. a grooming implement connected to the implement connecting structure.

B. The grooming device of paragraph A, wherein the location element is positioned adjacent the distal end of the neck portion.

C. The grooming device of paragraph A or B, wherein the displacement sensor is positioned adjacent the proximal end of the first portion.

D. The grooming device of any one of paragraphs A-C, further comprising a spring positioned between the distal end of the neck portion and the proximal end of the first portion.

E. The grooming device of any one of paragraphs A-D, wherein the grooming device comprises an electric shaver, a shaving razor and/or an epilator.

F. The grooming device of any one of paragraphs A-E, wherein an algorithm calculates a load being placed on the grooming implement based on displacement of the location element.

G. The grooming device handle of any one of paragraphs A-F, further comprising a feedback mechanism positioned in the first portion.

H. The grooming device of paragraph G, wherein the feedback mechanism comprises a visual indicator, an LED, a vibration mechanism, and/or an audio mechanism.

I. The grooming device of paragraph H, wherein the feedback mechanism indicates a pressure or a load state.

J. The grooming device of any one of paragraphs A-I, wherein the grooming device comprises an eject button to eject the grooming implement from the handle, the location element being negatively displaced upon depression of the eject button providing an indication that the grooming implement has been ejected.

K. The grooming device of any one of paragraphs A-J, wherein the displacement sensor comprises a magnetometer, an electric field sensor or a light sensor.

L. The grooming device of paragraph K, wherein the magnetometer comprises a hall effect sensor.

M. The grooming device of any one of paragraphs A-L, wherein the location element comprises a magnet, visual marker or an electrically conductive material.

N. The grooming device of paragraph M, further comprising a second magnetometer positioned within the housing.

O. The grooming device of any one of paragraphs A-N, wherein the distal end of the neck portion is pivotably connected to the proximal end of the first portion by a hinge.

P. The grooming device of paragraph O, wherein the hinge comprises an elastomer, a plastic material, a pin or a metal.

Q. The grooming device of any one of paragraphs A-P, further comprising a memory storage device positioned within the housing.

R. The grooming device of any one of paragraphs A-Q, further comprising a communication device positioned within the housing.

S. The grooming device of paragraph R, wherein the communication device communicates with a second device.

T. The grooming device of any one of paragraphs A-S, wherein the housing is watertight.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A grooming device comprising:

a. a handle and a grooming implement, the handle comprising;

i. a first portion comprising a housing, a proximal end and a distal end;

ii. a displacement sensor positioned within the housing;

iii. a power source positioned within the housing, the power source providing power to the displacement sensor;

iv. a neck portion comprising a proximal end, a distal end and a location element, the proximal end of the neck portion comprising an implement connecting structure to connect the grooming implement to the handle, the distal end of the neck portion being pivotably connected to the proximal end of the first portion about a handle pivot axis, as the neck portion pivots about the handle pivot axis relative to the first portion the displacement sensor detects displacement of the location element; and v. an eject button to eject the grooming implement from the handle, the eject button being connected to the location element such that the location element is negatively displaced upon depression of the eject button providing an indication that the grooming implement has been ejected.

2. The grooming device of claim 1, wherein the location element is positioned adjacent the distal end of the neck portion.

3. The grooming device of claim 1, wherein the displacement sensor is positioned adjacent the proximal end of the first portion.

4. The grooming device of claim 1, further comprising a spring positioned between the distal end of the neck portion and the proximal end of the first portion.

5. The grooming device of claim 1, wherein the grooming device comprises an electric shaver, a shaving razor and/or an epilator.

6. The grooming device of claim 1, wherein an algorithm calculates a load being placed on the grooming implement based on displacement of the location element.

7. The grooming device handle of claim 1, further comprising a feedback mechanism positioned in the first portion.

8. The grooming device of claim 7, wherein the feedback mechanism comprises a visual indicator, an LED, a vibration mechanism, and/or an audio mechanism.

9. The grooming device of claim 8, wherein the feedback mechanism indicates a pressure or a load state.

10. The grooming device of claim 1, wherein the displacement sensor comprises a magnetometer, an electric field sensor or a light sensor.

11. The grooming device of claim 10, wherein the magnetometer comprises a Hall Effect sensor.

12. The grooming device of claim 1, wherein the location element comprises a magnet, visual marker or an electrically conductive material.

13. The grooming device of claim 12, further comprising a second displacement sensor positioned within the housing.

14. The grooming device of claim 1, wherein the distal end of the neck portion is pivotably connected to the proximal end of the first portion by a hinge.

15. The grooming device of claim 14, wherein the hinge comprises an elastomer, a plastic material, a pin or a metal.

* * * * *